United States Patent [19]

Carmo

[11] Patent Number: 4,664,463

[45] Date of Patent: May 12, 1987

[54] PLUG AND CONNECTOR CLAMP

[75] Inventor: Robert A. Carmo, Placentia, Calif.

[73] Assignee: Pacific Electricord Company, Gardena, Calif.

[21] Appl. No.: 808,566

[22] Filed: Dec. 13, 1985

Related U.S. Application Data

[63] Continuation-in-part of Ser. No. 739,910, May 31, 1985, abandoned.

[51] Int. Cl.[4] ..... H01R 13/639

[52] U.S. Cl. ..... 339/75 P; 339/119 C; 339/147 C

[58] Field of Search ..... 339/75 P, 103 R, 119 C, 339/147 C

[56] References Cited

U.S. PATENT DOCUMENTS

| | | | |
|---|---|---|---|
| 2,406,567 | 8/1946 | Schueneman | 339/75 P |
| 2,753,536 | 7/1956 | Tjader | 339/75 P |
| 2,903,669 | 9/1959 | Gilman et al. | 339/75 P |
| 2,976,374 | 3/1961 | Poulsen | 339/147 C |
| 3,383,639 | 5/1968 | Anderson et al. | 339/75 P |

FOREIGN PATENT DOCUMENTS

| | | | |
|---|---|---|---|
| 818717 | 7/1969 | Canada | 339/75 P |
| 1084602 | 3/1978 | Canada | 339/75 P |
| 2313198 | 9/1973 | Fed. Rep. of Germany | 339/103 R |

*Primary Examiner*—John McQuade

*Attorney, Agent, or Firm*—Fulwider, Patton, Rieber, Lee & Utecht

[57] ABSTRACT

A plug and connector clamp for maintaining engagement between an electrical plug and connector. The clamp includes a housing having sides and end abutments defining a central space for receiving the plug and connector. The sides prevent sideways disconnection of the plug and connector in at least one plane. Various structures are disclosed for releasably engaging and urging together the plug and connector within the central space. The clamp preferably is carried by an extension cord in readiness for association of its connector with the plug of a selected electrical fitting or appliance.

17 Claims, 22 Drawing Figures

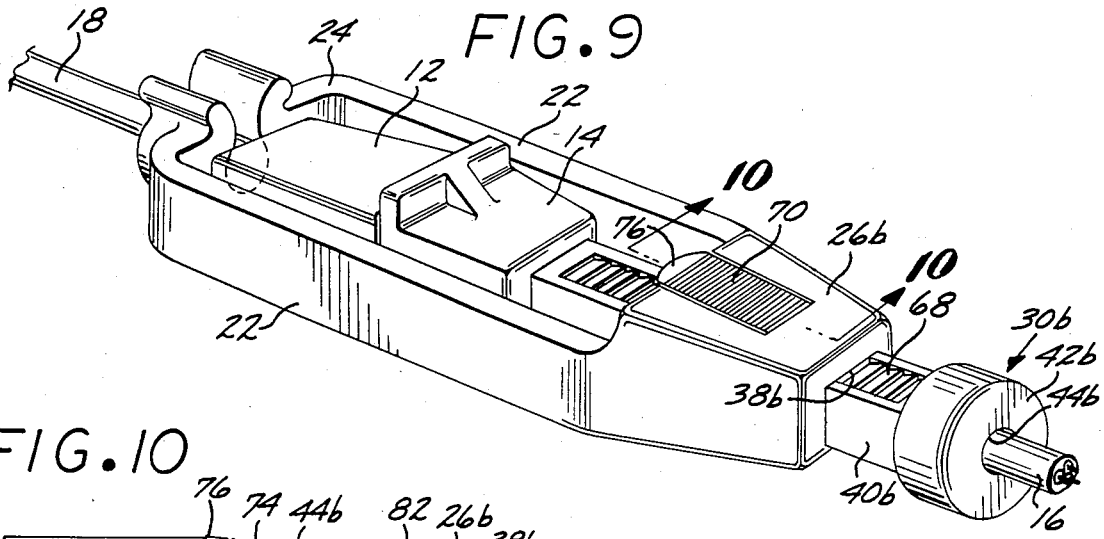
FIG. 9
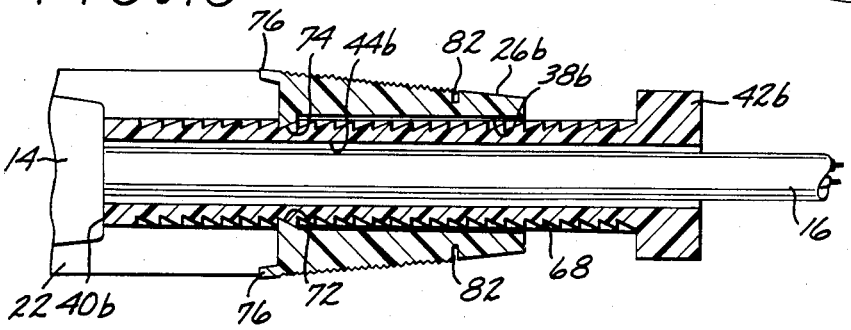
FIG. 10
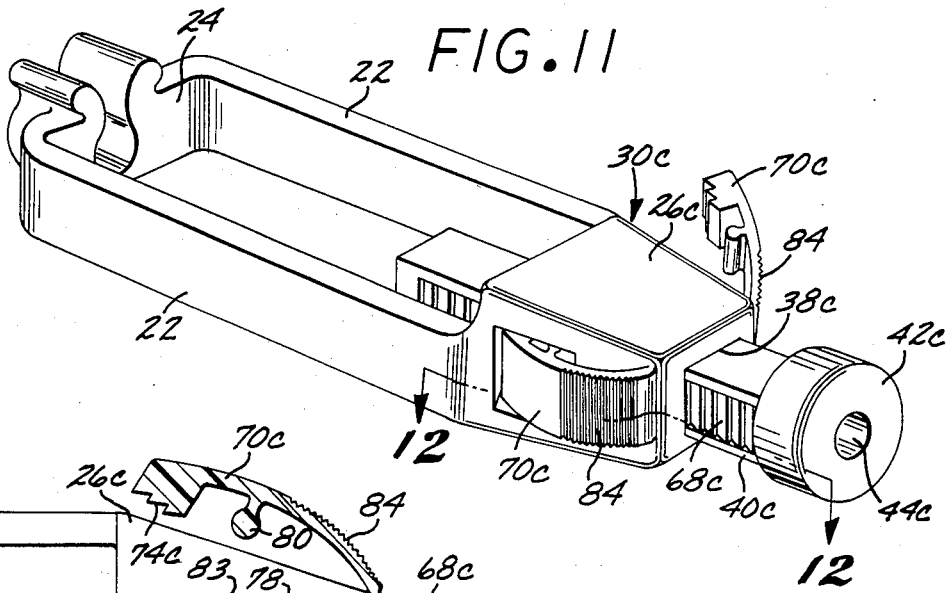
FIG. 11
FIG. 12

FIG. 13
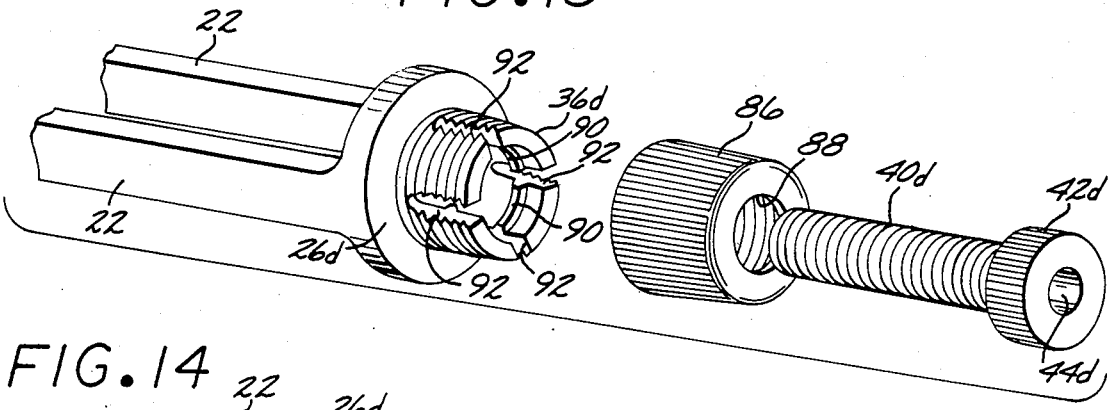
FIG. 14
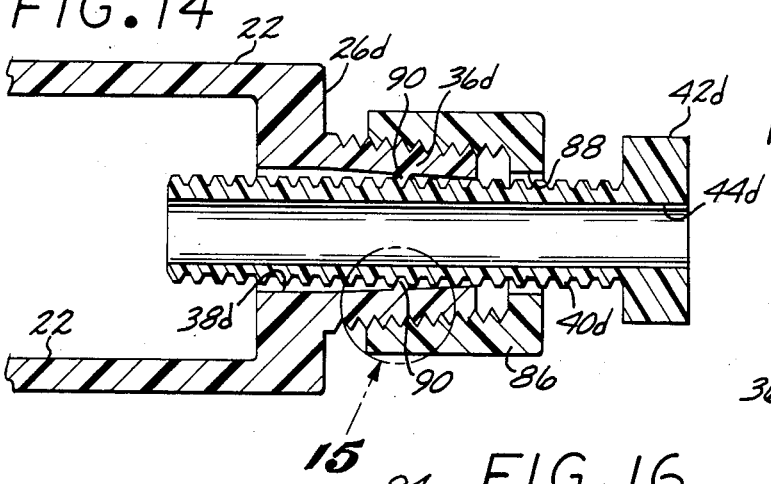
FIG. 15
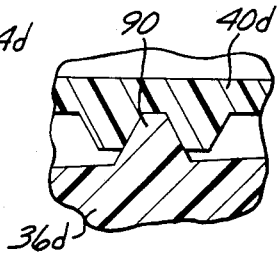
FIG. 16
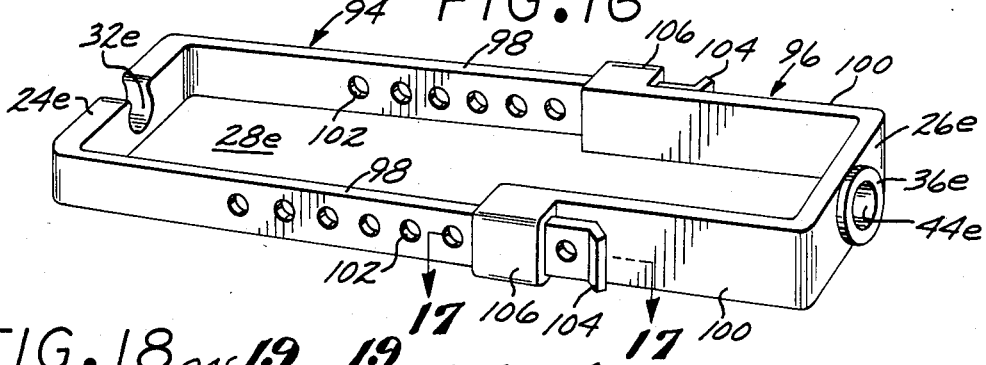
FIG. 18
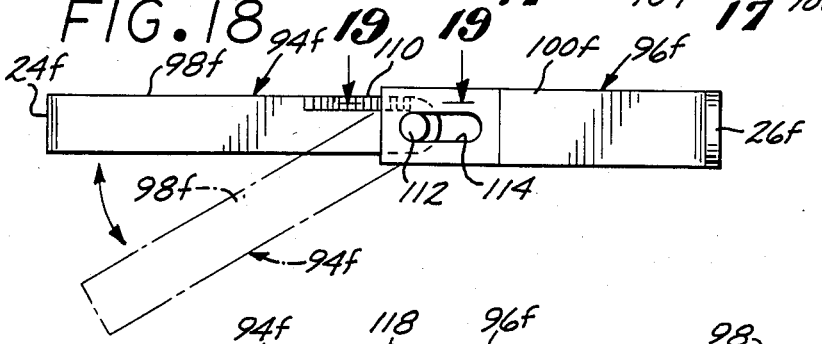
FIG. 17
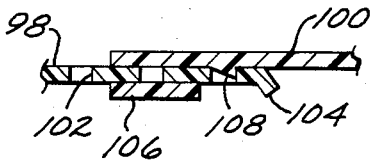
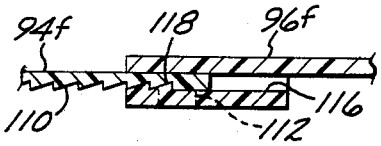
FIG. 19

FIG. 20
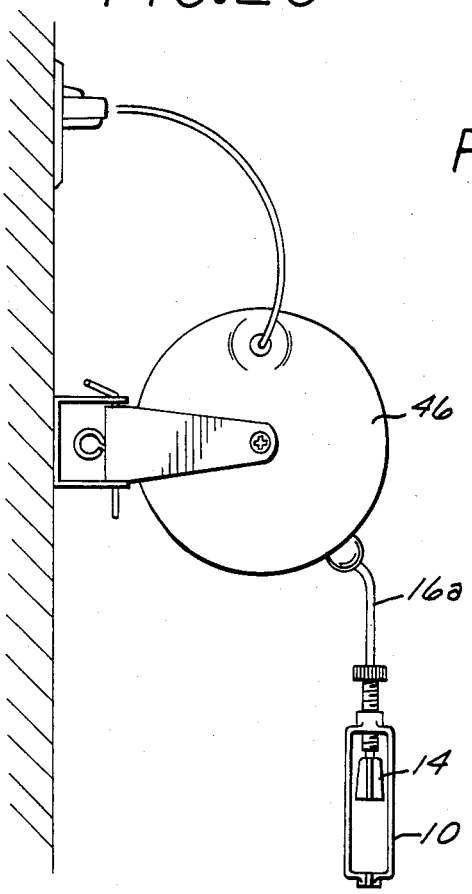
FIG. 21
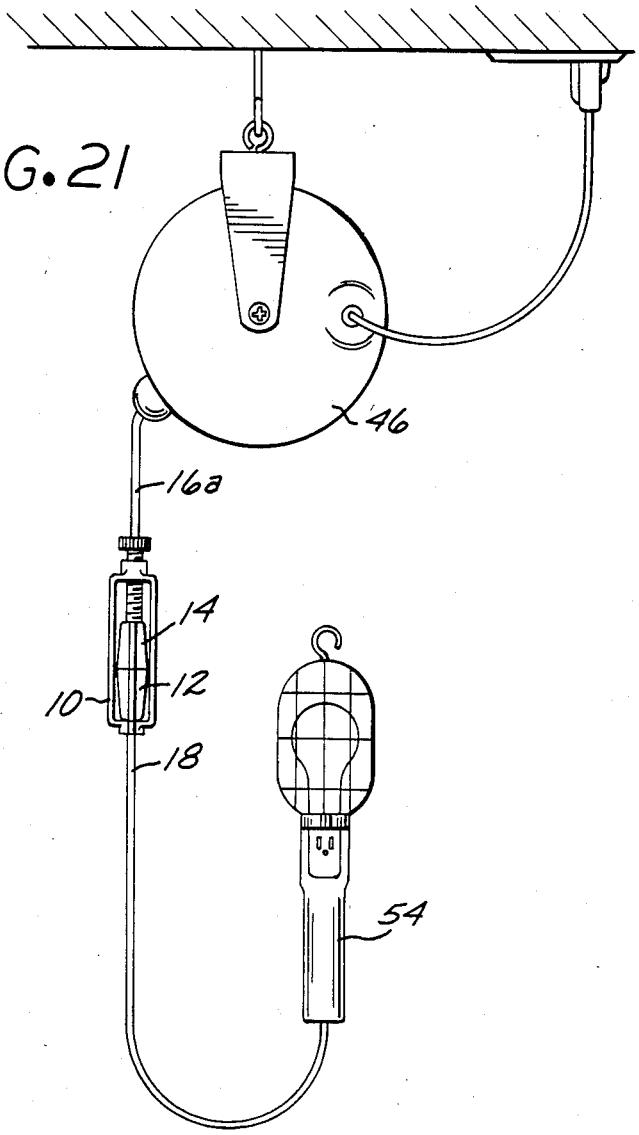
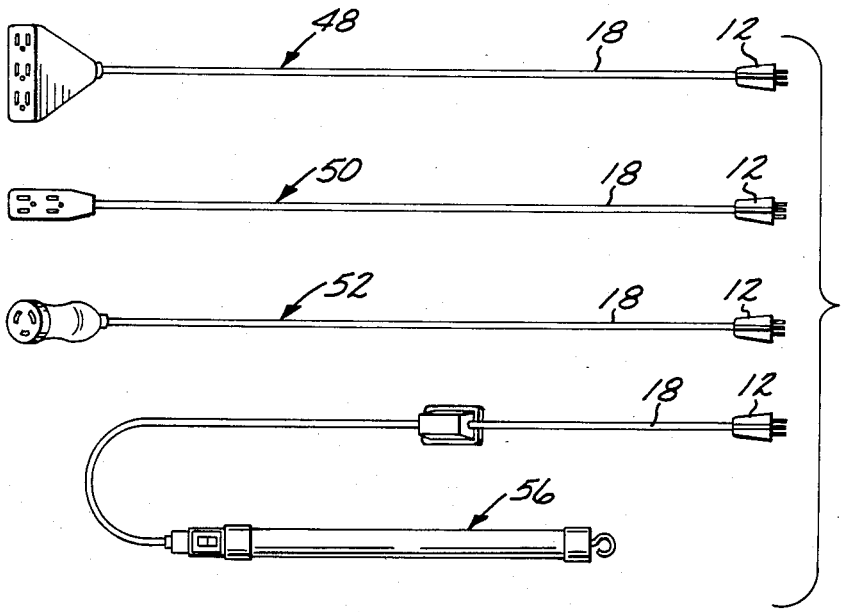
FIG. 22

PLUG AND CONNECTOR CLAMP

This is a continuation-in-part of application Ser. No. 739,910, filed May 31, 1985, now abandoned.

BACKGROUND OF THE INVENTION

1. Field of the Invention

The present invention relates to a plug and connector clamp for maintaining engagement between an electrical plug and connector, and more specifically, to such a clamp for accomplishing this without forcibly gripping the electrical cords.

2. The Prior Art

A portable electrical appliance such as a power saw, vacuum cleaner or the like is often used with an extension cord connected to the electrical cord of the appliance. The connected cords sometimes snag on obstructions during movement of the appliance and pull apart the connection between the plug of the appliance and the female fitting or connector of the extension cord. Sometimes the plug and connector only partially separate, dangerously exposing portions of the plug contacts.

Various contrivances have been proposed for clamping together such a plug and connector to prevent their inadvertent separation. These include the devices described in U.S. Pat. Nos. 2,753,536 (Tjader); 3,609,638 (Darrey); 3,999, 828 (Howell); and 4,221,449 (Shugart, Jr.), none of which satisfactorily prevents electrical fittings from being pulled apart.

The device disclosed by Howell employs a friction clamp to frictionally grip the cord of a fitting, to retain the fitting in mating contact with a second fitting. However, such a friction clamp does not work reliably when the cord is wet or oily. Moreover, if such a clamp is used repeatedly on the same cord, the cord insulation is eventually damaged by the abrading action of the clamp.

The device disclosed by Darrey is adjustable only after removal from the cords being clamped. Further, it is characterized by protrusions that can snag on foreign objects, especially if the joined cords are dragged over rough ground.

The Shugart device is retained in position by the engagement under tension of a locking member having serrations. The Tjader device employs a spring clamp. Both devices are subject to abrupt disengagement if subjected to vibration or a sudden pull on the cords.

It will be apparent from the foregoing that there is a need for a clamp adapted to reliably maintain engagement between an electrical plug and connector without damaging the plug and connector cords, and without protusions or the like which are likely to snag on foregin objects.

SUMMARY OF THE INVENTION

According to the present invention, a plug and connector clamp is provided which securely maintains a plug and connector in mating contact without any necessity for forcibly gripping their cords. The clamp does not damage the insulation of the cords with repeated use and it is not susceptible to failure under vibration, or as a result of sudden pulls on the plug and connector cords. Further, its configuration reduces any tendency for it to snag on foreign objects.

The present plug and connector clamp comprises an elongated housing having spaced apart sides and end abutments defining a central space for receiving an engaged plug and connector. The cords extending from the plug and connector pass through openings in the end abutments. The housing sides are adapted to be engaged by the coupled plug and connector to constrain sideways movement and possible separation of the plug and connector in at least one plane. The sides are externally configured to reduce possible snagging of the clamp on foreign objects.

In one embodiment one of the abutment openings threadably mounts a clamp portion through which one of the cords extends. Threaded advancement of the clamp portion urges it against the mated plug and connector, compressin them between it and the opposite end abutment of the housing. The clamp portion is preferably permanently carried by the extension cord of the connector, but in one embodiment certain of the clamp elements are longitudinally split to enable lateral insertion and removal of the extension cord relative to the clamp.

Other embodiments of the clamp utilize different means for urging the clamp portion against an engaged plug and connector, including a partial thread interengagement between the housing end abutment and the clamp portion whereby the clamp portion is longitudinally slidable against the engaged plug and connector, followed by a threaded rotation which further urges the clamp portion against the engaged plug and connector. Yet other embodiments employ ratchet mechanisms or resiliently movable detent means to hold the clamp portion in its engaged position, or means for selectively bringing the housing end abutments together for clamping together the engaged plug and connector.

An important feature of the present plug and connector clamp is that it can be permanently associated with the female fitting or connector of an extension cord, and particularly an extension cord carried by a wind-up reel or other relatively expensive cord storage device. Heretofore the extension cord of such a reel often integrally and permanently mounted a particular electrical fitting such as a trouble light to avoid any possible separation of connection, particularly under difficult conditions of use. Consequently, separate reels often have to be purchased for each such fitting to assure integrity of the extension cord fitting connection. In contrast, the present plug and connector clamp can be unitary with the reel extension cord so that a single reel can accommodate any one of many fittings simply by plugging the selected fitting into the extension cord connector and securing the connector with the clamp.

Other features and advantages of the present invention will become apparent from the following more detailed description taken in conjunction with the accompanying drawings.

BRIEF DESCRIPTION OF THE DRAWINGS

FIG. 9 is a perspective view of another embodiment of the present plug and connector clamp, illustrating a ratchet means for advancing the clamp portion;

FIG. 10 is an enlarged view taken along the line 10—10 of FIG. 9;

FIG. 11 is a perspective view of another embodiment of the present plug and connector clamp, illustrating another form of ratchet means for advancing the clamp portion;

FIG. 12 is an enlarged view taken along the line 12—12 of FIG. 11;

FIG. 13 is a perspective exploded view of yet another embodiment of the present plug and connector clamp, illustrating a detent system for engaging and constraining the clamp portion against longitudinal movement once it is positioned adjacent an engaged plug and connector;

FIG. 14 is an enlarged partial longitudinal cross sectional view of the embodiment of FIG. 13 in assembled form;

FIG. 15 is an enlarged view taken in the area designated by the numeral 15 in FIG. 14;

FIG. 16 is a perspective view of an embodiment of the present clamp which is characterized by a two section housing having end abutments movable toward one another to clamp together a plug and connector;

FIG. 17 is a view taken along the line 17—17 of FIG. 16;

FIG. 18 is a side elevational view of another two section housing embodiment, in this instance characterized by a pin and slot and ratchet interconnection for urging the housing end abutments toward on another for clamping together a plug and connector;

FIG. 19 is an enlarged view taken along the line 19—19 of FIG. 18;

FIG. 20 is a side elevational view of an embodiment of the embodiment of FIG. 4 as it would appear in association with a reel mounted extension cord;

FIG. 21 is a side elevational view of a reel mounted extension cord similar to that of FIG. 20, and illustrating the manner of connection of a common "trouble" light to the reel cord; and FIG. 22 is a view of several typical electrical fittings adapted for connection to a connector associated with the present plug and connector clamp, and particularly a connector carried by a reel mounted extension cord.

DESCRIPTION OF THE PREFERRED EMBODIMENT

Figure 1:
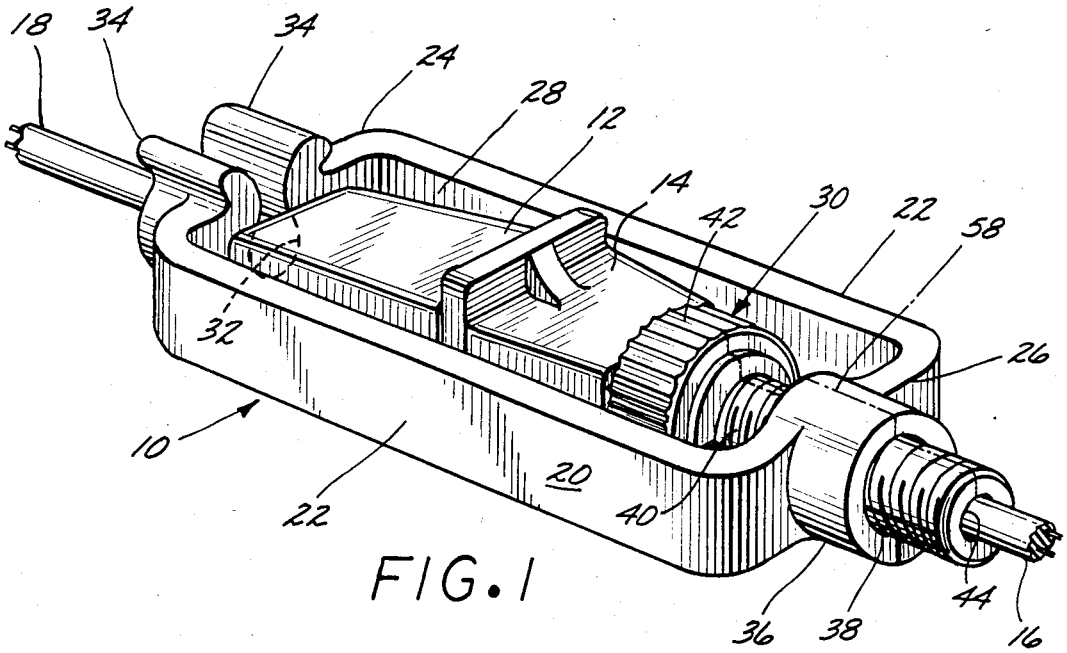
FIG. 1 is a perspective view of an embodiment of the present plug and connector clamp in use in association with an engaged plug and connector.
Figure 2:
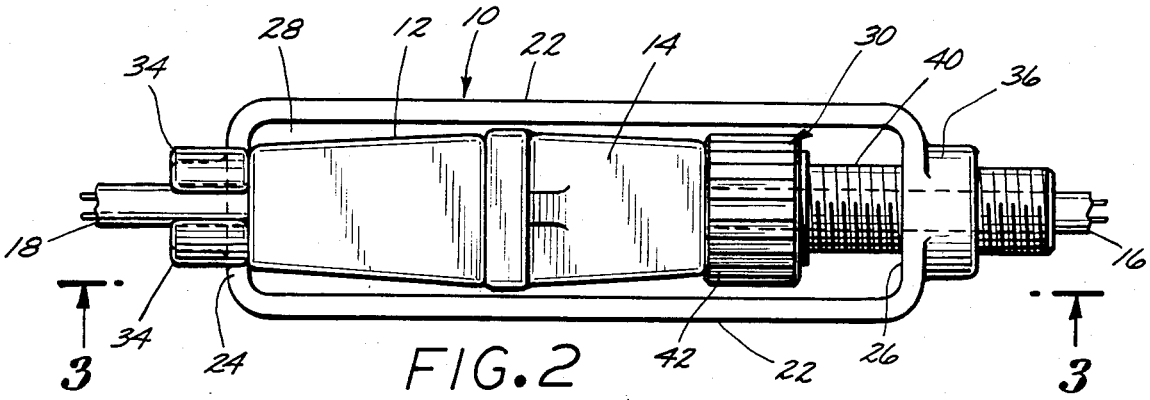
FIG. 2 is a top plan view of the clamp of FIG. 1.
Figure 3:
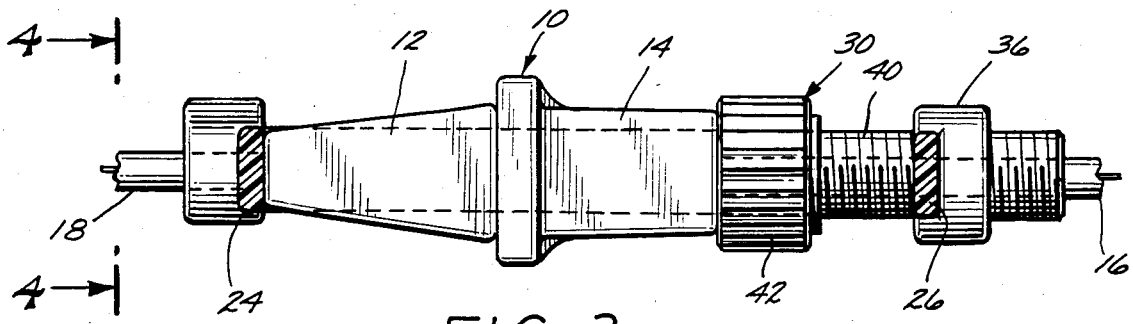
FIG. 3 is a view taken along the line 3—3 of FIG. 2.
Figure 4:
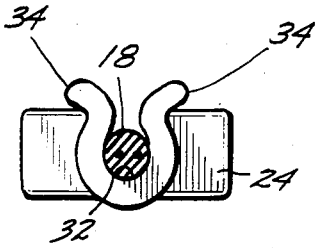
FIG. 4 is a view taken along the line 4—4 of FIG. 3.

Referring now to the drawings, and particularly to FIGS. 1-8, there is illustrated a plug and connector clamp 10 for maintaining engagement between an engaged electrical plug 12 and a female fitting or connector 14 carried by electrical cords 18 and 16, respectively.

The clamp 10 is preferably made of any suitable moldable plastic material having some degree of resilience and flexibility, and comprises, generally, a housing 20 having a pair of laterally spaced apart sides 22, and first and second end abutments 24 and 26. The sides and abutments define an elongated central space 28 for receiving the engaged plug 12 and connector 14, with the plug and connector constrained by the sides 22 against sideways movement in the general plane within which the plug, connector and sides 22 lie. This tends to prevent bending or longitudinal misalignment of the plug and connector connection, which could expose the bare plug and connector contacts. The somewhat flexible, resilient material of the clamp 10 also allows the sides 10 to bulge or bow outwardly to a limited degree to accommodate oversize plugs and connectors.

The rounded junctures of the sides 22 and the end abutments tend to prevent possible snagging of the clamp 10 upon foreign objects during movement of the clamp and cords within a work area, for example.

In properly secured position within the central space 28, the plug 12 engages the first end abutment 24 and a clamping means 30 carried by the second end abutment 26 engages the connector 14, urging it against the plug 12 to maintain the integrity of the interconnection.

The first end abutment includes a cord opening 32 adapted to receive the cord 18. The opening is characterized by a narrowed entry throat which is defined by a pair of confronting cord guides or retainers 34. The limited flexibility of the material of the clamp 10 allows the cord 18 to be pressed into the cord opening 32 by outwardly deflecting the retainers 34. However, the flexibility is not enough to allow the cord 18 to be pulled outwardly past the retainers 34 without a significant or deliberate effort.

The second end abutment 26 is characterized by an integral boss 36 having an internally threaded clamp opening 38 through which the clamping means 30 extends. The clamping means 30 includes a shank or externally threaded clamp portion 40 threadably carried within the clamp opening 38, and further includes an enlarged diameter portion or thumbwheel 42 integral with the clamp portion 40 and operable to rotate the clamping means 30. The clamping means 30 also includes a central bore or cord opening 44 which axially slidably receives the connector cord 16.

The housing 20 is preferably of unitary construction, and permanently mounted to the cord 16. This is accomplished by permanently molding the connector 14 to the cord 16, locating the connector 14 within the central space 28, and then leading the cord 16 out through the cord opening 44 for connection to a male plug, cord reel or the like. In use the clamp 10/connector 14 combination may be associated with any extension cord, as will be apparent, but it has particular value in association with an extension cord, like that illustrated at 16*a* in FIG. 20.

The cord 16*a* forms part of a relatively expensive retraction reel 46 which is typically mounted to the wall or ceiling of a work area. Heretofore such a reel was ordinarily used only with a single, permanently attached electrical fitting such as a trouble light or the like. This was for the reason that the pulling force required to unreel the extension cord 16*a* was often great enough to pull apart the connection between the cord and the trouble light. Since the present clamp 10 provides such a reliable, "pull-proof" connection, a single reel 46 can be used with any one of various electrical fittings, such as the special receptacle cords 48, 50 and 52 illustrated in FIG. 22, or the trouble light 54 or 56 illustrated in FIGS. 21 and 22.

To employ a selected one of the electrical fittings, such as the trouble light 54, it is only necessary to connect the plug 12 and connector 14, press the trouble light cord 18 past the narrow throat between the cord retainers 34 and into the cord opening 32, and then rotate the thumbwheel 42 to threadably advance the clamp portion 40 inwardly and into engagement with the connector 14. Continued rotation of the thumbwheel 42 firmly presses the plug 12 and connector 14 against each other and against the first end abutment 24. The resulting plug and connector connection is very secure and highly resistant to separation, regardless of forcible pulling upon the cords 16 and 18.

If desired, the clamp 10 can be made so that it is separable from the connector 14 and extension cord 16, but mountable to them when needed. This can be done by cutting or slitting through the end abutment boss 36 and the clamping means 30, as illustrated diagrammatically at 58 in FIG. 1. The limited flexibility of the clamp material enables the slit components to be pried apart sufficiently to enable the cord 18 to be laterally inserted through the slit 58 into the cord opening 44.

Figure 5:
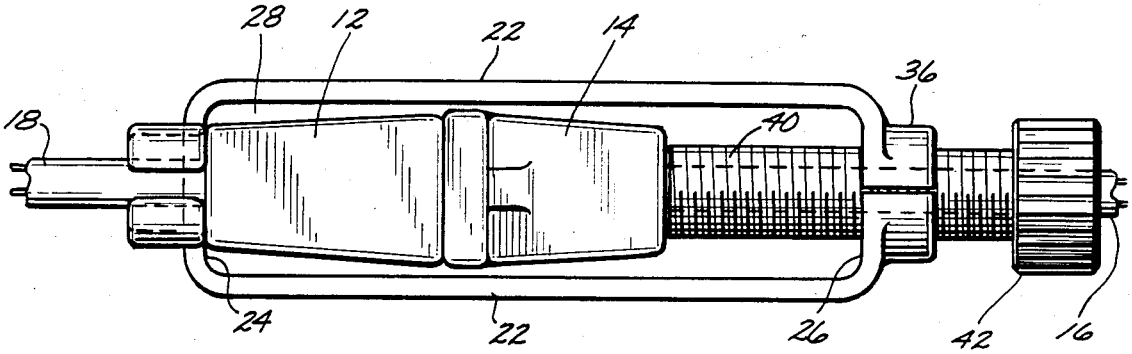
FIG. 5 is a view of another embodiment of the present clamp wherein the actuating thumbwheel is located outside the housing.

Location of the thumbwheel within the central space 28 is not critical. It can be located externally of the housing 20 as an integral part of the outer end of the clamp portion 40, as seen in the embodiment of FIG. 5.

Various other embodiments of clamping means may be utilized, if desired, as seen in certain of the other figures of the drawings. In describing these and other embodiments of the present clamp 10, like numerals are used for like components, with a lower case letter being used to designate similar but not identical components. In addition, different lower case letters are employed for the different embodiments. Thus, in the embodiment of FIG. 6 the clamp portion **40*a* is similar to the clamp portion 40 of the embodiment of FIG. 1 except for the thread placement. The clamp portion 40*a* is longitudinally cut away on opposite sides to define unthreaded flats or portions 60 between intervening threaded portions 62**.

Figure 6:
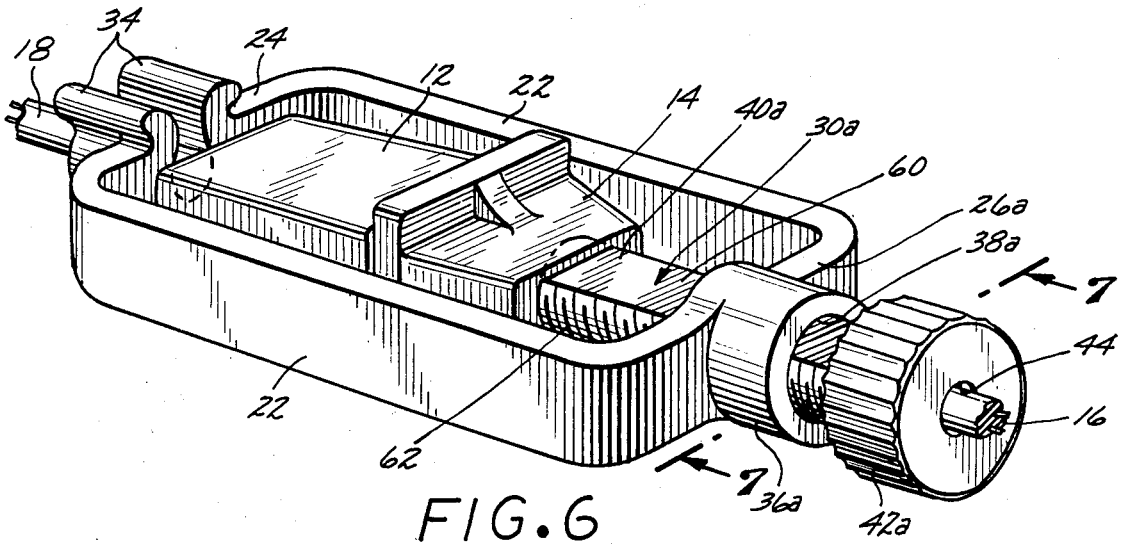
FIG. 6 is a perspective view of yet another embodiment of the present clamp wherein the clamp portion of the clamping means is longitudinally slidably advanceable, and thereafter threadably advanceable for forcible clamping.
Figure 7:
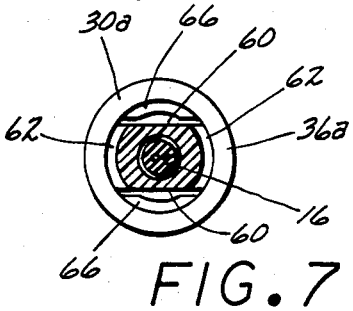
FIG. 7 is a sectional view taken along the line 7—7 of FIG. 6, showing threaded portions of the clamping portion and housing end abutment out of threaded engagement.
Figure 8:
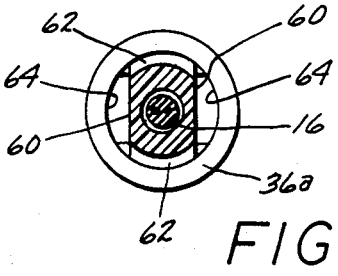
FIG. 8 is a view similar to FIG. 7, illustrating the components in threaded engagement.

The clamp opening **38*a* is provided with complementary unthreaded portions 64 and intervening threaded portions 66 so that when the threaded portions 62 of the clamp portion 40*a* are aligned with the unthreaded portions 64 of the clamp opening 38*a*, the clamp portion 40*a* can move freely in a longitudinal direction to bring the end of the clamp portion 30*a* into engagement with the adjacent connector 14 to compress the connector 14 and plug 12 between it and the end abutment 24. Turning the clamp portion 40*a* a quarter turn clockwise, from the position of FIG. 7 to the position of FIG. 8, engages the threaded portions 62 and 66 and compresses the plug 12 and connector 14. It also locks the clamp portion 40*a* against further longitudinal movement. Thus, the embodiment of FIGS. 6–8 provides a means for quickly advancing the clamping means 30*a* into a holding or clamping position and locking it in that position, as compared with the fully threaded advancement arrangement disclosed in connection with the embodiment of FIG. 1**.

Referring now to FIGS. 9 and 10, yet another embodiment of clamping means is illustrated. In this embodiment a modified end abutment **26*b* includes an unthreaded clamp opening 38*b* for longitudinally slidably receiving an elongated clamp portion 40*b* which integrally mounts a pushing boss 42*b*** at its outer extremity.

The clamp portion **40*b* is generally rectangular in transverse cross section and includes a central cord opening 44*b* for slidably receiving the extension cord 16. In addition, the upper and lower surfaces of the clamp portion 40*b* include a series of longitudinally extending ratchet teeth 68**.

Portions of the end abutment **26*b* which define the upper and lower walls of the clamp opening 38*b* take the form of a pair of resilient, inwardly biased and oppositely disposed ratchet arms 70. The bases of the arms 70 are integral with the end abutment 26 and include slots 82 adjacent their bases which facilitate pivotal movement of their free extremities away from the clamp portion 40*b***.

As best seen in FIG. 10, the free ends of the ratchet arms 70 include projections 74 normally engaged with the ratchet teeth 68. This arrangement permits inward longitudinal ratcheting movement of the clamp portion **40*b***, but prevents opposite longitudinal movement.

Each ratchet arm 70 includes a projecting tab 76 for grasping and pulling the arms 70 outwardly to disengage the projections 74 from the ratchet teeth 68. This enables free slidable movement of the clamp portion **40*b* in an outward direction for disconnection and removal of the plug 12** when desired.

The clamping means **30*c* of FIGS. 11 and 12 is a variation of the ratchet system of FIGS. 9 and 10. Like the embodiment of FIGS. 9 and 10, the clamping means 30*c* includes a clamp portion 40*c* which is generally rectangular in transverse cross section, and which mounts a pushing boss 42*c* integral with its outer extremity. Ratchet teeth 68*c* are formed in the opposite sides of the clamp portion 40*c***.

The end abutment 30 includes side walls 78 which are cut away to provide side openings providing access to the ratchet teeth **40*c*. A pair of ratchet arms 70*c* are integral at their bases with the side walls 78 and are inwardly biased but outwardly pivotable by reason of the resilient nature of the material of the clamp. The free extremities of the ratchet arms 70*c* include projections 74*c* which normally extend through the openings into engagement with the ratchet teeth 68*c* of the clamp portion 40*c***.

The ratchet arms **70*c* each include an outwardly bowed portion that extends from its base to the location of a fulcrum post 80. The posts 80 are integral with the ratchet arms 70*c* and include rounded ends which fit within detents or sockets 83 provided in the walls 78. Finger and thumb pressure against ridged sections 84 on the exterior of the bowed portions of the arms 70*c* tends to flatten the bowed portions, lifting the projections 74*c* out of engagement with the ratchet teeth 68*c* and enabling free outward slidable movement of the clamp portion 40*c* relative to the end abutment 26*c***.

Yet another form of clamping means is illustrated in the embodiment of FIGS. 13–15. In this embodiment the end abutment boss **36*d* is divided into sections by four slots 92, and is provided with tapered external threads. These are engageable by tapered internal threads of a clamping nut 86. The nut 86 includes a central bore 88 which enables the nut 86 to freely fit over the external Acme threads of a clamp portion 40*d* which mounts a pressing boss 42*d*** at its outer extremity.

An unthreaded clamp opening **38*d* extends through the end abutment 26*d* and the boss 36*d* and is characterized by a circumferentially disposed, radially inwardly directed locking ridge or detent 90**.

The engaged plug and connector (not shown) is initially fitted within the clamp, as in previous embodiment, at which time the nut 86 is backed off so that its threads engage only the outermost threads of the boss 36*d*. The detent 90 is out of engagement with the threads of the clamp portion 40*d* so that the push boss 42*d* will freely move the clamp portion 40*d* into engagement with the connector (not shown). At this point, tightening of the nut 86 onto the boss 36*d* will have the effect of radially inwardly bending or deforming the resilient walls of the boss 36*d* to bring the detent 90 into locking engagement with the threads of the clamp portion 40*d*. The sectioned walls of the boss 36*d* are more easily inwardly deformable by the action of the tapered threads of the nut 86. This prevents any further longitudinal movement of the clamp portion in either direction.

The embodiments of FIGS. 16 and 17 are adapted to receive an engaged plug and connector in essentially the same fashion as the embodiments previously described. However, the clamping action on the plug and connector is provided by virtue of a shortening of the length of the housing. Thus, in the embodiment of FIGS. 16 and 17, the housing is defined by a pair of U-shape housing sections 94 and 96 arranged in opposed relation and having end abutments 24*e* and 26*e* formed by the bases of the housing sections 94 and 96, respectively.

The housing sections 94 and 96 further include spaced apart sides 98 and 100, respectively, formed by the spaced apart legs of the housing sections 94 and 96. The abutments 24*e* and 26*e*, and the sides 98 and 100, define an elongated central space 28*e* for receiving an engaged plug and connector, as described in connection with the other embodiments of the present invention.

The housing section sides 98 include longitudinally spaced apart openings or detents 102, and terminate in outwardly directed tabs 104.

The housing section sides 100 include apertured end portions constituting receptacles 106 for longitudinally slidably receiving the housing section sides 98. As best seen in FIG. 17, each side 100 also includes, adjacent the receptacle 106, and outwardly directed projection 108. The projection 108 has a sloping surface adapted to engage the tab 104 of the associated side 98 just after it slides through the adjacent receptacle 106. The resilience of the side 98 enables it to resiliently deflect, and the tab 104 and subsequent detents 102 then can slide over the projection 108 during movement of the housing sections 94 and 96 toward each other to shorten the central space 28*e*. However, the opposite face of the projections 108 is abrupt and engages the detents 102 to prevent opposite movement of the housing sections. This locks the engaged plug and connector in secured relation.

When it is desired to remove or disconnect the plug from the connector within the central space 28*e*, the tabs 104 are manually grasped and deformed outwardly while contemporaneously pulling the housing sections apart.

With reference to FIGS. 18 and 19, an embodiment of the present clamp is illustrated which is somewhat similar in operation to the embodiment of FIGS. 16 and 17, that is, it depends upon a change in the length of a pair of housing sections to effect the desired holding or clamping action on a plug and connector. Thus, a pair of housing sections 94*f* and 96*f* are normally longitudinally aligned to define a central plug and connector space. In addition, they are longitudinally movable toward one another to secure together the plug and connector. The closing movement of the housing sections 94*f* and 96*f*is a ratcheting action, as will be seen. The ratchet mechanism is disengaged to permit opening movement of the housing sections by pivoting the housing sections relative to one another.

More particularly, the exterior edge surfaces of the free extremities of the housing section sides 98*f* are provided with a longitudinal array of ratchet teeth 110. In addition, the free ends of the sides 98*f* also include exteriorly directed pivot bosses or pins 112.

The pins 112 are pivotally and longitudinally slidably received within slots 114 provided in the outer wall of an opened ended box section which is integral with the free extremity of each side 100*f*. The interior of each of the box sections constitutes a longitudinally extending guideway 116 through which the free extremities of the complemental legs 98*f* are longitudinally slidable.

The outer wall of each box section also includes interiorly directed projections 118 which complementally engage the ratchet teeth 110. This permits free ratcheting movement of the legs 98*f* during closing movement of the housing sections for clamping a plug and connector. However, the ratchet mechanism prevents longitudinal opening movement of the housing sections.

When it is desired to unclamp a plug and connector and remove the plug, the sides 98*f* are pivoted to the phantom line position illustrated in FIG. 18. This disengages the projections 118 from the ratchet teeth 110 and enables slidable opening movement of the pins 112 within the slots 114.

From the foregoing description of the various embodiments of the invention, it will be seen that each provides a convenient means for reliably clamping a plug and connector together without locking onto the associated electrical cords. It is unaffected by forcible pulling on the cords, and is configured to reduce snagging on foreign objects. Although the clamp can take the form of a separate device adapted for fitting onto a connector, it is preferably marketed in combination with a connector. In that form it is always readily available to insure the integrity of any connection between the connector and an electrical fitting or appliance plug. Such a combination is particularly suited for use with an extension cord reel to enable use of the reel with any kind of electrical fitting having a mating plug.

Various modifications and changes may be made with regard to the foregoing detailed description without departing from the spirit of the invention.

I claim:

1. A plug and connector clamp for maintaining engagement between an engaged electrical plug and connector carried by electrical cords, said clamp comprising:

a housing including spaced apart sides and first and second end abutments defining an elongated central space for receiving said engaged plug and connector whereby said sides are adapted to constrain said plug and connector against sideways movement in at least one plane, and whereby said first end abutment is adapted to engage said engaged plug and connector, said first and second end abutments including a first cord opening and a clamp opening, respectively; and clamping means extending through said clamp opening and including a second cord opening and a clamp portion longitudinally movable against said engaged plug and connector in said central space to hold said engaged plug and connector between said first abutment and said clamp portion and thereby constrain said plug and connector against longitudinal separation.

2. A plug and connector clamp according to claim 1 wherein said housing and said clamping means are longitudinally split to enable lateral insertion and removal of an electrical cord relative to said second cord opening.

3. A plug and connector clamp according to claim 1 wherein said clamping means is threadedly carried within said clamp opening for threaded longitudinal movement of said clamp portion.

4. A plug and connector clamp according to claim 1 wherein said clamp opening is internally threaded, and said clamping means comprises an externally threaded shank threadably disposed within said clamp opening and including a central bore defining said second cord opening and said clamp portion comprises a thumbwheel integral with said shank.

5. A plug and connector clamp according to claim 1, in combination with an electrical extension cord carrying an electrical connector at one end, said connector being disposed within said central space, and said second cord opening receiving said extension cord whereby said plug and connector clamp form part of said extension cord.

6. A plug and connector clamp according to claim 5 wherein said first cord opening is laterally open whereby the electrical cord of a plug engaged with said connector can be laterally inserted into said first cord opening for location of said plug in said central space adjacent said first end abutment.

7. A plug and connector clamp according to claim 1 wherein said clamp opening is internally threaded and the threads are interrupted to define longitudinally directed unthreaded portions, and wherein said clamping means comprises an exteriorly threaded shank disposed within said clamp opening and centrally bored to define said second cord opening, the threads of said shank being interrupted to define longitudinally directed threaded portions adapted for longitudinal slidable movement along said unthreaded portions to urge said clamp portion against said engaged plug and connector in said central space, said shank being rotatable relative to said clamp opening for interengaging the threads of said clamp opening and said shank to threadedly advance said clamp portion against said engaged plug and connector.

8. A plug and connector clamp according to claim 1 wherein said clamping means comprises a shank centrally bored to define said second cord opening, said shank being longitudinally slidable through said clamp opening and including externally directed, longitudinally extending ratchet teeth, said second abutment carrying ratchet means biased inwardly for engagement with said ratchet teeth to fix said shank against longitudinal movement away from said central space.

9. A plug and connector clamp according to claim 8 wherein said ratchet means comprise a pair of resilient, oppositely disposed ratchet arms pivotally mounted to said second abutment and carrying projections for engagement with said ratchet teeth, each of said ratchet arms including a projecting tab enabling said ratchet arms to be pulled outwardly for disengaging said ratchet teeth.

10. A plug and connector clamp according to claim 8 wherein said ratchet means is integral with said second abutment.

11. A plug and connector clamp according to claim 8 wherein said ratchet means comprises a pair of resilient, oppositely disposed ratchet arms pivotally mounted to said second abutment and carrying projections at their free extremities for engagement with said ratchet teeth, said ratchet arms being of bowed configuration whereby pressure upon the central portions of said ratchet arms tends to flatten said bowed configuration and disengage said projections from said ratchet teeth.

12. A plug and connector clamp according to claim 11 wherein said ratchet arms include inwardly directed fulcrum posts adjacent said free extremities, respectively, said posts providing fulcrums to facilitate disengagement of said projections from said ratchet teeth upon flattening of said bowed configuration.

13. A plug and connector clamp for maintaining engagement between an engaged electrical plug and connector carried by electrical cords, said comprising:

a housing including spaced apart sides and first and second abutments defining an elongated central space for receiving said engaged plug and connector whereby said sides are adapted to constrain said plug and connector against sideways movement in at least one plane, and whereby said first end abutment is adapted to engage said engaged plug and connector, said first end abutment including a first cord opening and said second end abutment including a resilient, externally threaded boss having a clamp opening and a radially inwardly directed detent extending into said clamp opening; and clamping means extending through said clamp opening, and including a second cord opening and an externally threaded clamp portion longitudinally slidably movable within said clamp opening out of engagement with said detent for engagement with said engaged plug and connector in said central space, said clamping means including an internally threaded nut longitudinally slidably receiving said clamp portion and threaded onto said boss whereby tightening said nut upon said boss is adapted to deform said boss sufficiently to move said detent into engagement with the threads of said clamp portion and prevent slidable longitudinal movement of said clamp portion within said clamp opening.

14. A plug and connector clamp for maintaining engagement between an engaged electrical plug and connector carried by electrical cords, said clamp comprising:

a pair of U-shape housing sections arranged in opposed relation to define a housing having first and second end abutments formed by the bases of said housing sections, respectively, and further having spaced apart sides formed by the spaced apart legs of said housing sections, said abutments and said sides defining an elongated central space for receiving said engaged plug and connector whereby said sides are adapted to constrain said plug and connector against sideways movement in at least one plane, said first and second end abutments including first and second cord openings, respectively, said legs of said first housing section having longitudinally spaced apart detents, and said legs of said second housing section having receptacles longitudinally slidably receiving said legs of said first housing section for locating said end abutments in a holding position against said engaged plug and connector to constrain said engaged plug and connector against separation, said legs of said second housing section further having projections removably receivable in selected ones of said detents for maintaining said end abutments in said holding position.

15. A plug and connector clamp for maintaining engagement between an engaged electrical plug and connector carried by electrical cords, said clamp comprising:

a pair of U-shape housing sections arranged in opposed relation to define a housing having first and second end abutments formed by the bases of said housing sections, respectively, and further having spaced apart sides formed by the spaced apart legs of said housing sections, said abutments and said sides defining an elongated central space for receiving said engaged plug and connector whereby said sides are adapted to constrain said plug and connector against sideways movement in at least one plane, said first and second end abutments including first and second cord openings, respectively, the free extremities of said legs of said housing sections having ratchet teeth interengaged upon longitudinal alignment of said housing sections and enabling relative movement of said housing sections toward each other for locating said end abutments in a holding position against said engaged plug and connector to constrain said engaged plug and connector against separation, said free extremities further having pin and slot connections enabling pivotal movement of said housing sections out of said longitudinal alignment to disengage said ratchet teeth and allow relative movement of said end abutments out of said holding position.

16. An electric extension cord plug and connector clamp comprising:

an electrical extension cord having an electrical connector at one end; and a housing including spaced apart sides and first and second end abutments defining an elongated central space receiving said connector, said second end abutment including an opening through which said extension cord is disposed, said first end abutment including a first cord opening laterally open to seperably receive the electrical cord of an electrical plug upon engagement of said plug with said connector and location of said plug in said central space adjacent said first end abutment, said housing including clamping means operative to prevent longitudinal separation of said plug and connector in said central space, said clamping means including a clamp portion threadedly carried within said opening in said second end abutment for threaded longitudinal movement of said clamp portion toward said connector, and said extension cord being longitudinally slidably received within said opening in said second abutment whereby said connector is movable by said clamp portion relative to said second end abutment.

17. A cord plug and connector clamp according to claim 16 wherein said clamp portion includes a central bore receiving said extension cord and further includes a thumbwheel operative to rotate said clamp portion.

* * * * *